US008381821B2

(12) United States Patent
Hahn et al.

(10) Patent No.: US 8,381,821 B2
(45) Date of Patent: Feb. 26, 2013

(54) GAS LIFT VALVE

(75) Inventors: Jacob Hahn, Singapore (SG); Jason Kamphaus, Missouri City, TX (US); Kevin T. Scarsdale, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 374 days.

(21) Appl. No.: 12/628,689

(22) Filed: Dec. 1, 2009

(65) Prior Publication Data

US 2011/0127043 A1 Jun. 2, 2011

(51) Int. Cl.
*E21B 43/00* (2006.01)
*E21B 34/00* (2006.01)
*E21B 34/06* (2006.01)

(52) U.S. Cl. ..... 166/373; 166/319; 166/334.2; 166/372

(58) Field of Classification Search ..... 166/372, 166/373, 319, 334.2
See application file for complete search history.

(56) References Cited

U.S. PATENT DOCUMENTS

| | | | | | |
|---|---|---|---|---|---|
| 2,680,408 | A | * | 6/1954 | Davis | 166/53 |
| 2,804,830 | A | * | 9/1957 | Garrett et al. | 417/115 |
| 3,225,783 | A | * | 12/1965 | Stacha | 137/155 |
| 3,277,838 | A | * | 10/1966 | Canalizo | 417/112 |
| 3,311,126 | A | * | 3/1967 | Dudley | 137/155 |
| 3,353,605 | A | * | 11/1967 | Garrett et al. | 166/53 |
| 3,386,701 | A | * | 6/1968 | Potts | 251/229 |
| 3,642,070 | A | * | 2/1972 | Taylor et al. | 166/372 |
| 3,976,136 | A | | 8/1976 | Farley et al. | |
| 4,035,103 | A | * | 7/1977 | McMurry et al. | 417/109 |
| 4,110,057 | A | | 8/1978 | McMurry et al. | |
| 4,128,106 | A | * | 12/1978 | Abercrombie | 137/155 |
| 4,129,184 | A | * | 12/1978 | Parker | 166/385 |
| 4,270,606 | A | * | 6/1981 | McStravick et al. | 166/181 |
| 4,293,034 | A | * | 10/1981 | Mott | 166/208 |
| 4,458,751 | A | * | 7/1984 | Haynes | 166/133 |
| 4,475,598 | A | * | 10/1984 | Brakhage et al. | 166/321 |
| 5,022,427 | A | * | 6/1991 | Churchman et al. | 137/155 |
| 5,469,878 | A | * | 11/1995 | Pringle | 137/155 |
| 5,707,214 | A | | 1/1998 | Schmidt | |
| 5,743,717 | A | | 4/1998 | Schmidt | |
| 5,788,220 | A | | 8/1998 | Meziert, Sr. | |
| 5,950,733 | A | | 9/1999 | Patel | |
| 6,231,312 | B1 | * | 5/2001 | Pringle | 417/54 |
| 6,491,105 | B2 | * | 12/2002 | Holt, Jr. | 166/372 |
| 6,932,581 | B2 | | 8/2005 | Messick | |
| 7,228,909 | B2 | * | 6/2007 | Schmidt et al. | 166/372 |
| 7,647,975 | B2 | * | 1/2010 | Messick et al. | 166/372 |
| 7,784,553 | B2 | * | 8/2010 | Moreno | 166/386 |
| 2006/0137881 | A1 | * | 6/2006 | Schmidt et al. | 166/372 |
| 2010/0319924 | A1 | * | 12/2010 | Mahmoud et al. | 166/325 |

FOREIGN PATENT DOCUMENTS

WO 2005093209 A1 10/2005

* cited by examiner

*Primary Examiner* — David Andrews
*Assistant Examiner* — Michael Wills, III
(74) *Attorney, Agent, or Firm* — Jim Patterson

(57) ABSTRACT

A gas lift valve assembly includes a housing that includes a first passageway that is substantially concentric with the central passageway of a string to communicate well fluid and a second passageway that is eccentrically disposed with respect to the central passageway to communicate a second fluid to lift the well fluid. The gas lift valve assembly includes a valve that is disposed in the second passageway and includes a ball valve to regulate communication of the second fluid.

19 Claims, 3 Drawing Sheets

GAS LIFT VALVE

BACKGROUND

The invention generally relates to a gas lift valve.

A well typically includes a production tubing string for purposes of communicating well fluid to a surface of the well through a central passageway of the string. Due to its weight, the column of well fluid that is present in the production tubing string may suppress the rate at which the well fluid is produced from the formation. More specifically, the column of well fluid inside the production tubing string exerts a hydrostatic pressure that increases with well depth. Near a particular producing formation, the hydrostatic pressure may be significant enough to substantially impede the rate at which the well fluid is produced.

For purposes of reducing the hydrostatic pressure and thus, enhancing the rate at which fluid is produced, an artificial-lift technique may be employed. One such technique involves at various downhole points in the well, injecting gas into the central passageway of the production tubing string to lift the well fluid in the string. The injected gas, which is lighter than the well fluid displaces some amount of well fluid in the string. The displacement of the well fluid with the lighter gas reduces the hydrostatic pressure inside the production tubing string and allows the reservoir fluid to enter the wellbore at a higher flow rate. The gas to be injected into the production tubing string typically is conveyed downhole via the annulus (the annular space surrounding the string) and enters the string through one or more gas lift valves.

SUMMARY

In one example, a gas lift valve assembly includes a housing that includes a first passageway that is substantially concentric with the central passageway of a string to communicate well fluid and a second passageway that is eccentrically disposed with respect to the central passageway to communicate a second fluid to lift the well fluid. The gas lift valve assembly includes a valve that is disposed in the second passageway and includes a ball valve to regulate communication of the second fluid.

In another example, a method includes providing a gas lift valve that includes a ball valve element and operating the ball valve element to regulate fluid communication through the gas lift valve.

In yet another example, a system includes a string that includes a central passageway to communicate well fluid to the surface and gas lift valve assemblies. At least one of the gas lift valve assemblies includes a ball valve to regulate communication of a gas lift fluid into the central passageway of the string.

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
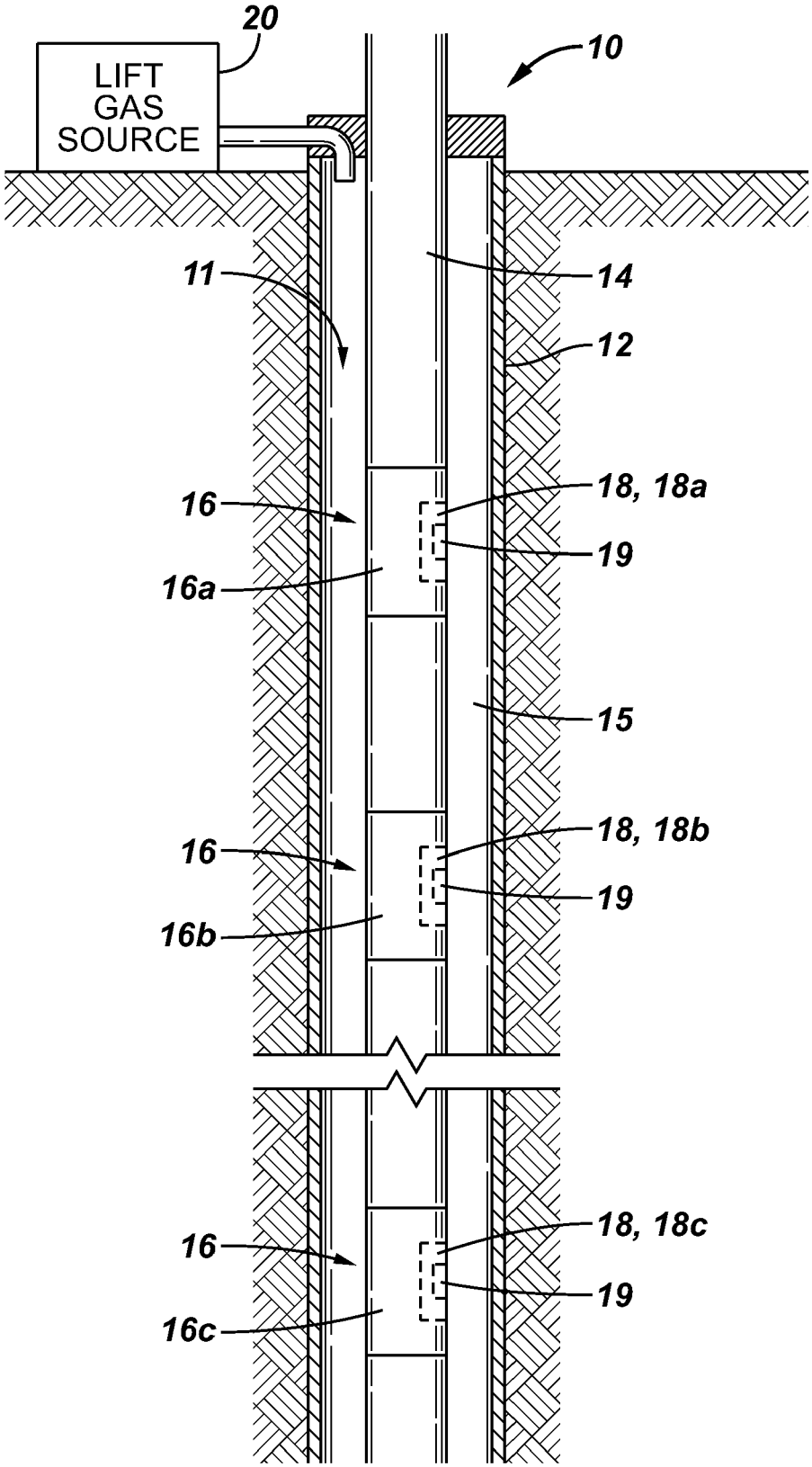
FIG. 1 is a schematic diagram of a well according to an example.

Referring to FIG. 1, a subterranean well 10 includes a wellbore 11 that extends downhole into one or more subterranean formations. As depicted in FIG. 1 for purposes of example, the wellbore 11 is vertical. However, the techniques and systems that are disclosed herein may likewise be applied to lateral or highly deviated wells. Additionally, the wellbore 11 may or may not be cased by a casing string 12, which is depicted in FIG. 1. Furthermore, the well 10 may be a terrestrial subterranean well or may be a subset well, as many variations are contemplated and are within the scope of the appended claims.

As depicted in FIG. 1, a production tubing string 14 extends downhole into the wellbore 11. The production tubing string 14 communicates well fluid to the surface of the well. For purposes of enhancing the rate at which well fluid is produced, an artificial-lift technique may be employed in which a lifting gas (provided by a surface-disposed lift gas source 12, for example) is injected into the production tubing string 14 to displace well fluid in the string 14 with the lighter gas to enhance the production of the well fluid. In general, the gas is communicated downhole via an annulus 15 of the well 10 and enters the production tubing string 14 at various controlled access points along the string 14.

More specifically, as an example, the production tubing string 14 may include several side pocket gas lift mandrels 16 (gas lift mandrels 16*a*, 16*b* and 16*c*, being depicted as examples in FIG. 1), which contain flow control devices to control the communication of gas from the annulus 15 into the central passageway of the string 14. More specifically, each of the gas lift mandrels 16 includes an associated gas lift valve 18 (gas lift valves 18*a*, 18*b* and 18*c*, being depicted as examples in FIG. 1) for purposes of establishing one way fluid communication paths from the annulus 15 into the central passageway of the production tubing string 14.

As described herein, the gas lift valves 18 are injection pressure operated (IPO) valves. In general, an IPO valve opens when the annulus pressure exceeds the production tubing string pressure by a certain threshold. The pressure thresholds of the gas lift valves 18 may be separately configured, which permits the gas lift valves 18 to be opened in a certain sequence. It is noted that the production tubing string 14 may contain more or less than the three gas lift valves 18 that are depicted in FIG. 1. Furthermore, the production tubing string 14 may contain one or more gas lift valves that have designs different than the design of the gas lift valve 18.

As described herein, the gas lift valve 18 includes a ball valve 19, which is constructed to be operated such that when the pressure of the annulus 15 near the gas lift valve 18 exceeds a certain threshold, the ball valve 19 opens to permit communication between the surrounding annulus and the central passageway of the production tubing string 14. The ball valve 19 is further constructed to automatically close when the annulus pressure near the gas lift valve 18 decreases below the threshold.

Due to the use of the ball valve 19 to control the flow through the valve 18, the valve 18 may be used in a barrier application. As a comparison, a conventional gas lift valve may use a check dart-type valve element for purposes of preventing a reverse flow through the gas lift valve when closed. However, these valve elements may deform when the element is used over a relatively wide pressure range, and this deformation may cause leakage. As such, conventional gas lift valves may not be suitable for a barrier application, which needs to seal over a wide range of pressures. In contrast, the ball valve design is capable of sealing over a wide range of pressures and thus, is suitable for use as a barrier device.

Figure 2:
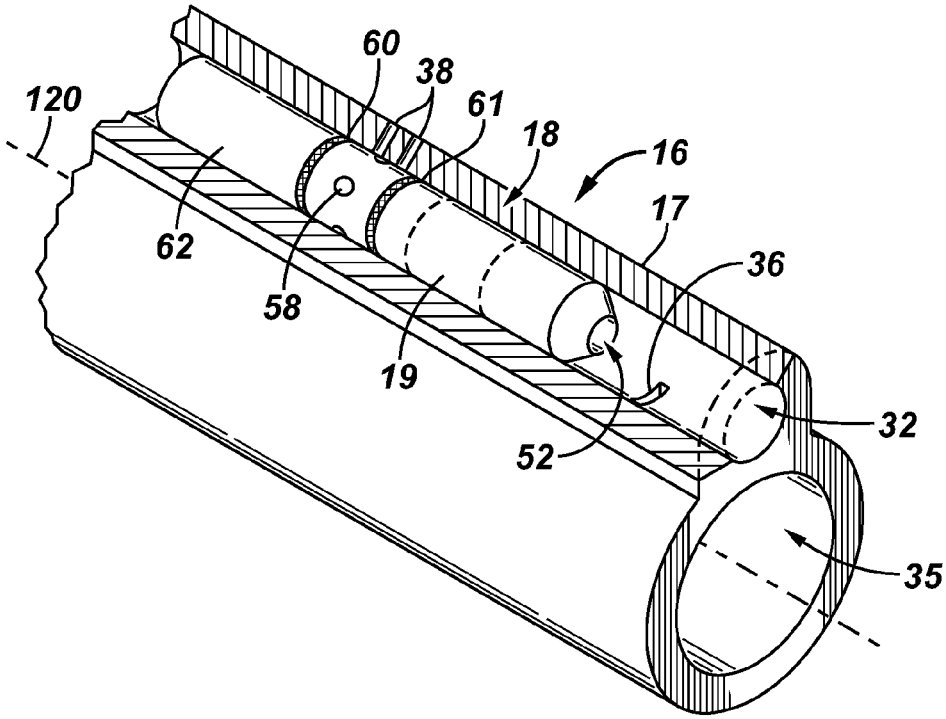
FIG. 2 is a schematic diagram of a gas lift valve assembly according to an example.

Referring to FIG. 2 in conjunction with FIG. 1, as an example, the side pocket gas lift mandrel 16 is a sub, or assembly, of the production tubing string 14, which houses the gas lift valve 18 and provides ports that permit communication between the annulus 15 and central passageway of the production tubing string 14. The gas lift mandrel 16 includes a tubular housing 17 that contains a central passageway 35 that is concentric with the longitudinal passageway 120 of the mandrel 16 and forms a corresponding section of the central passageway of the production tubing string 14. The housing 17 also includes a smaller diameter offset, or eccentrically-disposed, passageway 32 that is generally parallel with but is eccentric with respect to the longitudinal axis 120. As depicted in FIG. 2, the gas lift valve 18 is disposed inside the eccentrically-disposed passageway 32.

As shown in FIG. 2, the passageways 32 and 35 are generally parallel to each other, and the housing 17 includes at least one radial port 36 to establish fluid communication between the longitudinal passageways 32 and 35 when the gas lift valve 18 is open. The side pocket mandrel 16 further includes one or more radial ports 38 for purposes of establishing communication between the annulus 15 and one or more inlet ports 58 of the gas lift valve 18. In this regard, the gas lift valve 18 includes upper 60 and lower 61 seals (o-ring seals, v-ring seals or a combination of these seals, as non-limiting examples) that circumscribe the outer surface of the housing of the gas lift valve 18. These seals contact the inner wall of the passageway 32 to form a sealed annular space for receiving fluid from the annulus 15.

In general, the gas lift valve 18 controls fluid communication between the annulus 15 and the central passageway of the production tubing string 14 in the following manner. As long as the annulus pressure is below a certain threshold, the ball valve 19 of the gas lift valve 18 remains closed to block fluid communication between the inlet port(s) 58 and an outlet port 52 of the gas lift valve 18. Thus, when the ball valve 19 is closed, fluid communication does not occur through the gas lift valve 18. When the annulus pressure exceeds the threshold, as described further below, the ball valve 19 opens to permit fluid communication between the inlet port(s) 58 and the outlet port 52. When the ball valve 19 is open, fluid thus is communicated between the annulus 15, into the inlet port(s) 58, through the ball valve 19, through the outlet port 52, through the port(s) 36 and into the central passageway of the production tubing string 14.

It is noted that the gas lift valve 18 may be installed and/or removed from the production tubing string 14 by a wireline operation (as a non-limiting example). In this regard, as a non-limiting example, the gas lift valve 18 may include a latch 62, which is engageable by a tool at the end of a wireline for purposes of securing the gas lift valve 18 inside the passageway 32, as well as releasing the gas lift valve 18 from the side pocket mandrel 16 for purposes of retrieving the valve 18 to the surface of the well 10.

Figure 3:
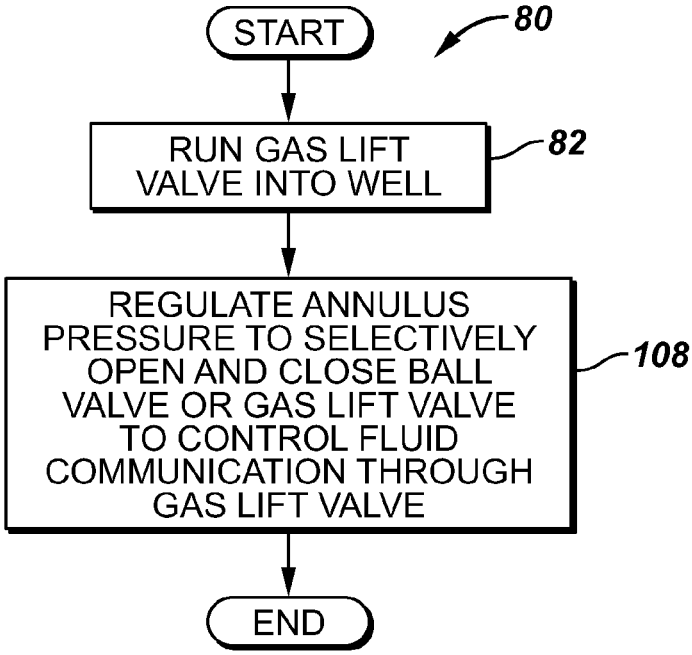
FIG. 3 is a flow diagram depicting an artificial lift technique according to an example.

Referring to FIG. 3, in accordance with embodiments of the invention, a technique 80 that is depicted in FIG. 3 may be used in conjunction with a gas lift valve. Pursuant to the technique 80, the gas lift valve is run into a well, pursuant to block 82. The annulus pressure is regularly, pursuant to block 108, to selectively open and close a ball valve of the gas lift valve to control fluid communication through the gas lift valve.

Figure 4:
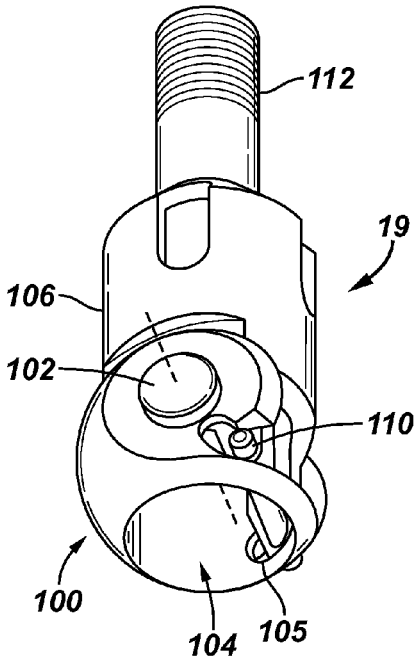
FIG. 4 is a perspective view of a ball valve according to an example.

Referring to FIG. 4, as a non-limiting example of a possible design for the ball valve 19, the valve 19 may include a ball element 100 that rotates about an axis 102 between open and closed positions. In this regard, the axis 102 is generally transverse to the longitudinal axis 120 of the production tubing string 14, and pivot points extend from the ball element 100 into corresponding recesses of the housing of the ball valve 19 to confine the ball element 100 to rotate about the axis 102.

The ball element 100 includes a central passageway 104, which is aligned with the central passageway of the production tubing string 14 in the open state of the ball valve 19. In the closed state of the ball valve 19, the ball element 100 is rotated so that the passageway 104 is no longer aligned with the central passageway of the production tubing string 14, but rather, for this orientation of the element 100, the solid portion of the element 100 blocks fluid communication through the valve 19.

The angular orientation of the ball element 100 about the axis 102 is controlled by a yoke 106 and a pin 110. The pin 110 is located near a lower end of the yoke 106 and resides in a slot 105 of the ball element 100. In general, the free end of the pin 110 resides in a longitudinal slot inside the housing of the gas lift valve 18 and is confined by the slot to move along the longitudinal axis 120 with the longitudinal translation of the yoke 106. Due to the eccentric positioning of the pin 110 with respect to the axis 102 of the ball element 100, upward movement of the yoke 106 causes the ball element 100 to rotate about the axis 102 to its closed position. Conversely, downward travel of the yoke 106 causes an opposite rotation of the ball element 100 for purposes of returning the ball element 100 to its open position (as depicted in FIG. 4). As also depicted in FIG. 4, in general, the yoke 106 includes a longitudinally extending operator 112 that is connected to an actuator (as further described below) for purposes of longitudinally translating the yoke 106 and thus, transitioning the ball valve 19 between its open and closed states.

Figure 5:
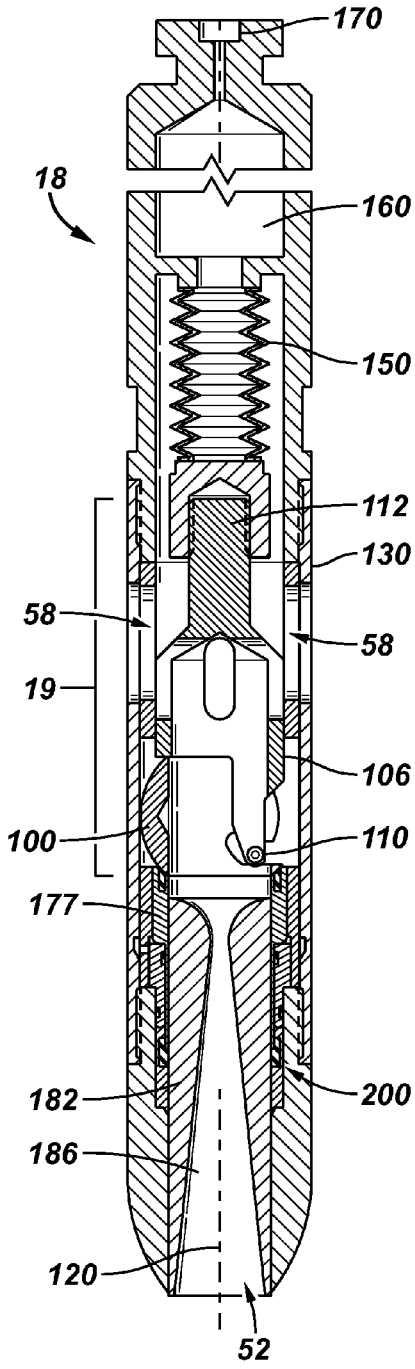
FIG. 5 is a cross-sectional view of the gas lift valve of FIG. 2 according to an example.

FIG. 5 depicts a non-limiting example of a possible implementation of the gas lift valve 18. For this example, the actuator for the ball lift valve 19 includes a metal bellows diaphragm 150. More specifically, the ball valve 19 is located inside an outer housing 130 of the gas lift valve 18. The outer housing 130 includes a longitudinal slot in which the pin 110 slides and also includes the radial ports 58 that are constructed to receive well fluid from the annulus 15 (see FIGS. 1 and 2, for example). The ball valve 19 controls fluid communication between the ports 58 and the lower port 52 of the valve 18, which is also formed in the housing 130.

The well fluid that enters the radial ports 58 exerts a pressure on a lower surface of the bellows 150 to form a corresponding upward force on the bellows 150. This upward force, in turn, is countered by a downward force that is created by a stored gas charge. The bellows 150 is connected to the operator 112 of the yoke 106 so that upward and downward movement of the bellows 150 induces a corresponding longitudinal translation of the yoke 106 and thus, controls the open and closed state of the ball valve 19.

A force that is created by gas in a pressurized upper gas chamber 160 of the gas lift valve 18 exerts a downward force on the opposite side of the bellows 150. In general, the gas pressure inside the chamber 160 biases the yoke 106 downwardly, thereby biasing the ball valve 19 to rotate to a position to form a fluid blocking seal against a valve seat 177 to close the valve 19. This biasing force, in turn, is overcome when the pressure that is exerted by the annulus fluid exceeds a predefined threshold. When this occurs, the upward force on the bellows 150 exceeds the downward force exerted by the gas in the chamber 160 to cause upward movement of the bellows 150 and yoke 106, thereby transitioning the ball valve 19 to its open state and permitting fluid communication through the ball valve seat 177 and port 52.

The annulus pressure required to open the ball valve 19 is set by the pressure charge inside the chamber 160. As depicted in FIG. 5, as a non-limiting example, the threshold may be established by adjusting the pressure of the gas charge. The gas may be introduced into the chamber 160 at an inlet fill port 170 in the outer housing 130.

In general, when the ball valve 19 is open, fluid is communicated between the inlet ports 58 and the outlet port 52 of the gas lift valve. As depicted in FIG. 5, as an example, the gas lift valve 18 may include a venturi 182 that is located between the ball seat 177 and the outlet 52. In general, the venturi housing 182 includes a venturi orifice 186, which minimizes turbulence in the flow of gas from the well annulus to the central passageway of the production tubing string 15.

In accordance with a non-limiting example, the gas lift valve 18 may include energized seal assemblies 200 (T-seal assemblies, V-seal assemblies, chevron assemblies, o-ring assemblies, etc.) to seal the ball element 110 against the ball valve seat 177. The energized seal assemblies 200 relax the tolerance requirements for the ball valve 19 and permit ease of operating the ball valve 19, especially in the case of high annulus pressures.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A gas lift valve assembly for use in a wellbore, comprising:

a housing comprising a first passageway substantially concentric with a central passageway of a string to communicate well fluid and a second passageway eccentrically disposed with respect to the central passageway to communicate a second fluid to lift the well fluid;

a valve disposed in the second passageway and comprising a ball valve having a ball element which is rotatable by a pin to regulate communication of the second fluid, the pin being moved via an operator positioned for movement in the second passageway; and an actuator positioned in the second passageway and coupled to the operator, the actuator being exposed to a wellbore annulus around the housing, the actuator being responsive to actuate the ball valve when annulus pressure exerted by a fluid in the wellbore annulus exceeds a predefined threshold, the operator being biased by a force aligned with the second passageway to return the ball element to an original position when the annulus pressure drops below the predetermined threshold.

2. The valve assembly of claim 1, wherein the ball valve comprises:

the pin eccentric with respect to the axis of rotation; and a yoke to be translated in response to annulus pressure and being attached to the pin to rotate the ball element between a closed position in which ball element blocks the communication of the second fluid and an open position in which the ball element permits communication of the second fluid.

3. The valve assembly of claim 2, wherein the ball valve is adapted to, in response to annulus pressure, translate between a first position in which ball element blocks the communication of the second fluid and a second position in which the ball element permits communication of the second fluid.

4. The valve assembly of claim 1, wherein the actuator is able to selectively transition the ball valve between a first position in which ball element blocks the communication of the second fluid and a second position in which the ball element permits communication of the second fluid.

5. The valve assembly of claim 4, further comprising:

a pressurized gas chamber to exert a force to bias the actuator to maintain the ball valve in the first position.

6. The valve assembly of claim 4, wherein the actuator comprises a bellows to respond to annulus pressure to transition the ball valve between the first and second positions.

7. The valve assembly of claim 6, further comprising:

a pressurized gas chamber to exert a force to bias the bellows to maintain the ball valve in the first position.

8. The valve assembly of claim 1, further comprising:

energized seals to seal against the ball valve.

9. A method comprising:

providing a gas lift valve comprising a ball valve element positioned in a second passageway aligned with and eccentrically located relative to a primary tubing string passageway;

placing the gas lift valve in a wellbore;

delivering a fluid under pressure down through a wellbore annulus external to the gas lift valve; and operating the ball valve element by controlling the pressure of the fluid in the wellbore annulus to cause an actuator to move along the second passageway and rotate the ball valve element and to thus regulate fluid communication through the gas lift valve.

10. The method of claim 9, wherein the act of operating comprises translating the ball valve element between a first position in which the ball element blocks the communication of fluid through the gas lift valve and a second position in which the ball element permits communication of the fluid through the gas lift valve.

11. The method of claim 9, wherein operating the actuator comprises communicating the pressure to a bellows.

12. The method of claim 9, further comprising:

biasing the ball valve to close, comprising exerting a force created by a pressurized gas chamber of the gas lift valve.

13. A system comprising:

a string comprising a central passageway to communicate well fluid to the surface and gas lift valve assemblies, wherein at least one of the gas lift valve assemblies comprises a ball valve having a ball element rotatable by a pin to regulate communication of a gas lift fluid into the central passageway of the string, the at least one gas lift valve assembly comprising an actuator coupled to the pin of the ball valve and exposed to a wellbore annulus around the string, the actuator being linearly movable along a passageway generally aligned with the central passageway to rotationally actuate the ball element via the pin when annulus pressure exerted by a fluid in the wellbore annulus exceeds a predefined threshold.

14. The system of claim 13, wherein the ball valve is adapted to, in response to annulus pressure, translate between a first position in which ball valve blocks the communication of the second fluid and a second position in which the ball valve permits communication of the second fluid.

15. The system of claim 13, wherein the actuator is able to selectively transition the ball valve between a first position in which ball element blocks the communication of the second fluid and a second position in which the ball element permits communication of the second fluid.

16. The system of claim 15, further comprising:

a pressurized gas chamber to exert a force to bias the actuator to maintain the ball valve in the first position.

17. The system of claim 15, wherein the actuator comprises a bellows to respond to annulus pressure to transition the ball valve between the first and second positions.

18. The system of claim 17, further comprising:

a pressurized gas chamber to exert a force to bias the bellows to maintain the ball valve in the first position.

19. The system of claim 13, further comprising:

energized seals to seal against the ball valve.

* * * * *